US009948034B2

(12) United States Patent
Takahashi

(10) Patent No.: US 9,948,034 B2
(45) Date of Patent: Apr. 17, 2018

(54) CONNECTOR AND ELECTRICAL WIRE UNIT

(71) Applicants: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

(72) Inventor: Keigo Takahashi, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 15/535,557

(22) PCT Filed: Dec. 11, 2015

(86) PCT No.: PCT/JP2015/084795
§ 371 (c)(1),
(2) Date: Jun. 13, 2017

(87) PCT Pub. No.: WO2016/098700
PCT Pub. Date: Jun. 23, 2016

(65) Prior Publication Data

US 2017/0352989 A1 Dec. 7, 2017

(30) Foreign Application Priority Data

Dec. 17, 2014 (JP) ..... 2014-255456

(51) Int. Cl.
*H01R 13/648* (2006.01)
*H01R 13/6585* (2011.01)

(52) U.S. Cl.
CPC ..... *H01R 13/6585* (2013.01)

(58) Field of Classification Search
CPC ..... H01R 13/6592; H01R 13/658; H01R 13/6585
See application file for complete search history.

(56) References Cited

U.S. PATENT DOCUMENTS 7,997,933 B2 * 8/2011 Feldman ..... H01R 23/688 439/108
8,007,308 B2 * 8/2011 Feldman ..... H01R 13/518 439/374

(Continued)

FOREIGN PATENT DOCUMENTS

JP H07-022107 A 1/1995
JP H11-265754 A 9/1999

(Continued)

OTHER PUBLICATIONS

Search Report for International Application No. PCT/JP2015/084795, dated Mar. 8, 2016, 4 pp.

*Primary Examiner* — Xuong Chung Trans
(74) *Attorney, Agent, or Firm* — Dinsmore & Shohl LLP

(57) ABSTRACT

A connector having favorable crosstalk characteristics and common conversion characteristics and high noise immunity is provided. The connector includes a first connector having at least one pair of first terminals disposed in one housing and a second connector that includes at least one pair of second terminals disposed in another housing, and configured to be connected to the one pair of first terminals. The connector includes at least one first terminal surrounding conductors fixed inside the one housing, individually surrounding the pairs of first terminals, and are insulated from other members, and at least one second terminal surrounding conductors are fixed inside the other housing, individually surrounding the pairs of second terminals, and are insulated from other members. When the first terminals are respectively connected to the second terminals, the first (Continued)

terminal surrounding conductors are respectively connected to the corresponding second terminal surrounding conductors as well.

4 Claims, 7 Drawing Sheets

(56) References Cited

U.S. PATENT DOCUMENTS

| | | | | |
|---|---|---|---|---|
| 9,362,659 | B2 * | 6/2016 | Jones | H01R 13/516 |
| 9,698,501 | B2 * | 7/2017 | Liptak | H01R 9/0518 |
| 2006/0246780 | A1 | 11/2006 | Bert et al. | |
| 2013/0237100 | A1 | 9/2013 | Affeltranger | |
| 2013/0337665 | A1 | 12/2013 | Cohen et al. | |
| 2016/0248203 | A1 | 8/2016 | Straka et al. | |

FOREIGN PATENT DOCUMENTS

| | | | |
|---|---|---|---|
| JP | 2008-525972 | A | 7/2008 |
| JP | 2008-541354 | A | 11/2008 |
| JP | 2013-093335 | A | 5/2013 |
| JP | 2014-502415 | A | 1/2014 |

* cited by examiner

CONNECTOR AND ELECTRICAL WIRE UNIT

CROSS-REFERENCE TO RELATED APPLICATIONS

This application is the U.S. national stage of PCT/JP2015/084795 filed Dec. 11, 2015, which claims priority of Japanese Patent Application No. JP 2014-255456 filed Dec. 17, 2014.

TECHNICAL FIELD

The present invention relates to a connector that includes a first connector including a pair or a plurality of pairs of first terminals and a second connector including a pair or a plurality of pairs of second terminals and that connects high speed communication lines (Ethernet (registered trademark)), and an electrical wire unit in which twisted pair lines serving as the high speed communication lines are connected to the connector.

BACKGROUND

Many electrical devices are installed in a vehicle, and many wire harnesses are used in order to supply power to these electrical devices and enable communication between the electrical devices. If the pair of wires of the wire harness are parallel lines, the influence of disturbance noise increases.

Therefore, if wire harnesses including high speed communication lines are connected by a standard connector for automobiles (0.64 type, multi-pin), twisted pair lines having high noise immunity are used for the high speed communication lines in order to suppress influence of disturbance noise.

However, because terminals in a connector portion are not configured as a twisted pair, the terminals in the connector portion are influenced by other lines that are arranged in proximity thereto, and as a result, crosstalk characteristics and normal/common conversion characteristics degrade, and noise immunity decreases.

Therefore, heretofore, special connectors for high speed communication, such as completely shielded connectors, have been used.

In JP 2008-525972A, a differential electrical connector is disclosed that includes differential pairs that are held in an insulating housing in a plurality of rows, and that connects printed circuit boards in an electronic system to each other.

A communication connector that includes a casing and a foil that at least partially covers the casing, and in which the foil is constituted by two portions separated by a gap, is disclosed in JP 2013-93335A.

As described above, there is a problem in that, if special connectors for high speed communication such as a completely shielded connector is used to connect wire harnesses, the component cost increases. Also, if the connector is provided with open pins (about 4 pins), although noise immunity improves, unnecessary pins increase, and therefore, this idea is unrealistic.

The present invention was made in view of circumstances such as those described above, and it is an object thereof to provide a connector that has preferable crosstalk characteristics and normal/common conversion characteristics and high noise immunity.

Also, an object of the present invention is to provide an electrical wire unit in which twisted pair lines are connected to a connector that has preferable crosstalk characteristics and normal/common conversion characteristics and high noise immunity.

SUMMARY

A connector according to a first invention, in a connector including a first connector that includes one pair or a plurality of pairs of first terminals that are provided in one housing, and that are configured to be connected to non-shielded electric wires and a second connector that includes one pair or a plurality of pairs of second terminals that are provided in another housing, and that are configured to be connected to the one pair or the plurality of pairs of first terminals, includes one or a plurality of first terminal surrounding conductors that are fixed inside the one housing, that individually surround the pairs of first terminals, and that are insulated from other members, and one or a plurality of second terminal surrounding conductors that are fixed inside the other housing, that individually surround the pairs of second terminals, and that are insulated from other members. The first terminals and the second terminals are respectively surrounded by the first terminal surrounding conductors and the second terminal surrounding conductors such that a cross-section of each terminal pair and the corresponding terminal surrounding conductor has a mirror symmetric shape whose axis of symmetry is a line in the middle between the terminals. When the first terminals are respectively connected to the second terminals, the first terminal surrounding conductors are respectively connected to the corresponding second terminal surrounding conductors as well.

In the connector, a first connector includes one pair or a plurality of pairs of first terminals that are provided in one housing, and that are configured to be connected to non-shielded electric wires, and a second connector includes one pair or a plurality of pairs of second terminals that are provided in another housing, and are respectively to be connected to the one pair or the plurality of pairs of first terminals. One or a plurality of first terminal surrounding conductors are fixed inside the one housing, individually surround the pairs of first terminals, and are insulated from other members, and one or a plurality of second terminal surrounding conductors are fixed inside the other housing, individually surround the pairs of second terminals, and are insulated from other members. The first terminals are surrounded by the first terminal surrounding conductors such that a cross-section of each terminal pair and the corresponding terminal surrounding conductor has a mirror symmetric shape whose axis of symmetry is a line in the middle between the terminals. The second terminals are surrounded by the second terminal surrounding conductors such that a cross-section of each terminal pair and the corresponding terminal surrounding conductor has a mirror symmetric shape whose axis of symmetry is a line in the middle between the terminals. When the first terminals are respectively connected to the second terminals, the first terminal surrounding conductors are respectively connected to the corresponding second terminal surrounding conductors as well.

In a connector according to a third invention, the first connector further includes a plurality of other first terminals arranged with a gap between them that is smaller than a gap between the first terminals, and the second connector further includes a plurality of other second terminals arranged with a gap between them that is smaller than a gap between the second terminals.

In the connector, the first connector further includes a plurality of other first terminals arranged with a gap between them that is smaller than a gap between the first terminals that are surrounded by the first terminal surrounding conductors, and the second connector further includes a plurality of other second terminals arranged with a gap between them that is smaller than a gap between the second terminals that are surrounded by the second terminal surrounding conductors.

An electrical wire unit according to a fourth invention includes the connector according to the present invention, one or a plurality of non-shielded twisted pair lines that are respectively connected to first terminal pairs included in the connector, and one or a plurality of non-shielded twisted pair lines are respectively connected to second terminal pairs included in the connector.

In the electrical wire unit, one or a plurality of twisted pair lines are respectively connected to the first terminal pairs included in the connector according to any of the first to third inventions, and one or a plurality of twisted pair lines are respectively connected to the second terminal pairs included in the connector.

According to the connector according to the present invention, a connector having favorable crosstalk characteristics and normal/common conversion characteristics and having high noise immunity can be realized.

According to the electrical wire unit according to the present invention, an electrical wire unit in which twisted pair lines are connected to a connector having favorable crosstalk characteristics and normal/common conversion characteristics and having high noise immunity can be realized.

DETAILED DESCRIPTION OF PREFERRED EMBODIMENTS

Hereinafter, the present invention will be described based on the drawings illustrating examples of the present invention.

EXAMPLE 1

Figure 1A:
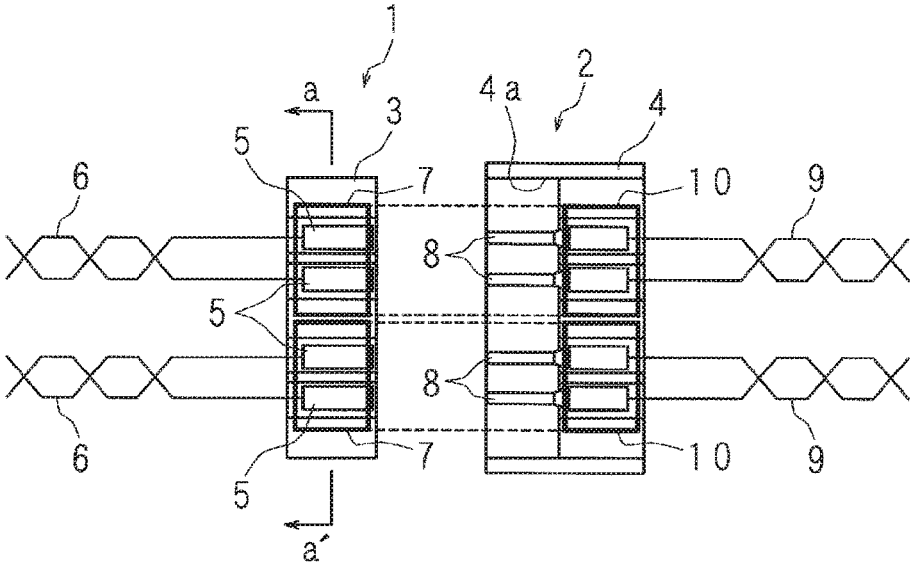
FIG. 1A is a cross-sectional view schematically illustrating a plane cross section of an example of a connector and an electrical wire unit according to the present invention.
Figure 1B:
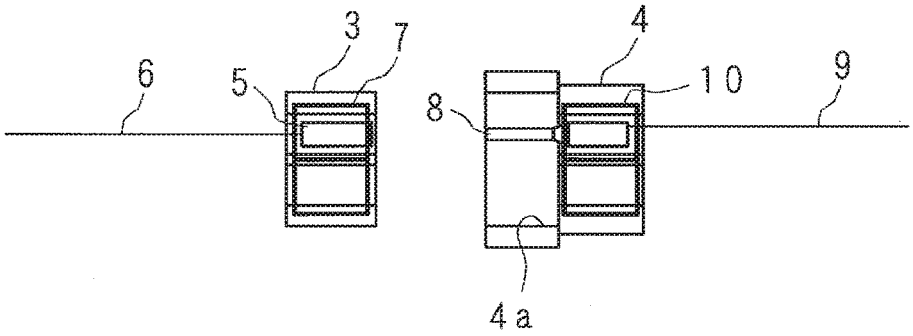
FIG. 1B is a cross-sectional view schematically illustrating a side cross section of the example of the connector and the electrical wire unit according to the present invention.
Figure 2:
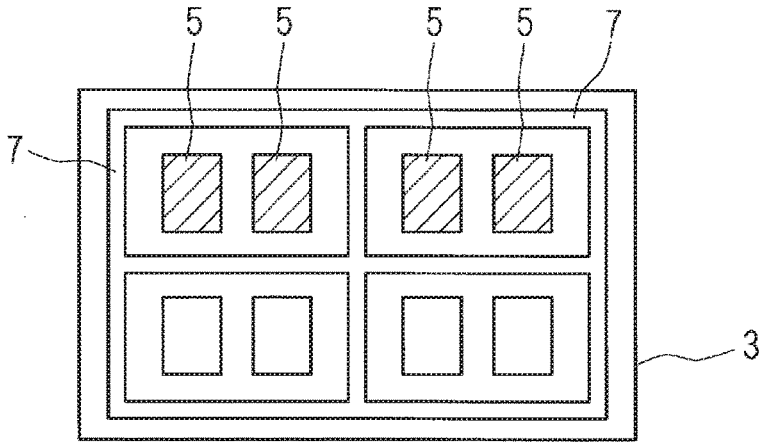
FIG. 2 is a cross-sectional view illustrating a transverse section taken along line a-a' in FIG. 1A.

FIG. 1A is a cross-sectional view schematically illustrating a plane cross section of Example 1 of a connector and an electrical wire unit according to the present invention, FIG. 1B is a cross-sectional view schematically illustrating a side cross section of Example 1, and FIG. 2 is a cross-sectional view illustrating a transverse section taken along line a-a' in FIG. 1A.

As shown in FIGS. 1A and 1B, the connector and the electrical wire unit include a female connector 1 (first connector or second connector) to which two pairs of twisted pair lines 6 are connected and that includes a housing 3 having a cuboid shape, and a male connector 2 (second connector or first connector) to which two pairs of twisted pair lines 9 are connected and that includes an approximately cuboid-shaped housing 4 that is provided with a recess 4*a* into which the female connector 1 is to be fitted.

Eight tube-shaped female terminals 5 (first terminals or second terminals) to each of which a pin-shaped male terminal 8 is fitted and connected are embedded into the female connector 1, and are arrayed in 4×2 rows on a connection side (note that, here, one row is empty), as shown in FIG. 2. The length of the housing 3 in a thickness direction (length direction of the twisted pair lines 6) is slightly larger than the length of the female terminals 5, as shown in FIGS. 1A and 1B.

Pairs of the female terminals 5 that are adjacent to each other are respectively surrounded by a lattice-shaped female terminal surrounding conductor 7 (first terminal surrounding conductor or second terminal surrounding conductor), as shown in FIG. 2, and are connected to the twisted pair lines 6. Each pair of the female terminals 5 and the portion of the female terminal surrounding conductor 7 that surrounds them have a mirror symmetric shape, in cross-section, whose axis of symmetry is a line in the middle between the two terminals. The female terminal surrounding conductor 7 is embedded into the housing 3 in a state of being insulated from other members.

Eight pin-shaped male terminals 8 (second terminals or first terminals) are embedded into the male connector 2, and are arrayed in 4×2 rows on a connection side (note that, here, one row is empty). The length of the housing 4 in a thickness direction (length direction of the twisted pair lines 9) is slightly larger than the length of the male terminals 8, as shown in FIGS. 1A and 1B, and approximately half of the respective male terminals 8 on a side connected to the twisted pair lines 9 is embedded into the housing 4, whereas the other half projects into the recess 4*a* into which the female connector 1 is to be fitted.

Portions of pairs of the male terminals 8 that are adjacent to each other that are embedded into the housing 4 are respectively surrounded by a lattice-shaped male terminal surrounding conductor 10 (second terminal surrounding conductor or first terminal surrounding conductor), and are connected to the twisted pair lines 9. Each pair of the male terminals 8 and the portion of the male terminal surrounding conductor 10 that surrounds them have a mirror symmetric shape, in cross-section, whose axis of symmetry is a line in the middle between the two terminals. The male terminal surrounding conductor 10 is embedded into the housing 4 in a state of being insulated from other members.

The female terminal surrounding conductor 7 and the corresponding male terminal surrounding conductor 10 have the same shape in cross-section.

In the connector and the electrical wire unit having such a configuration, when the female connector 1 is fitted into the recess 4*a* of the male connector 2, the pin-shaped male terminals 8 are respectively fitted into the tube-shaped female terminals 5 and are connected thereto. At this time, the corresponding female terminal surrounding conductor 7 and male terminal surrounding conductor 10 are connected, and the pairs of female terminals 5 and the pairs of male terminals 8 are surrounded by the female terminal surrounding conductor 7 and the male terminal surrounding conductor 10.

Accordingly, in the connector portion of the electrical wire unit, the characteristic impedance does not change much and crosstalk characteristics and normal/common conversion characteristics do not degrade, and noise immunity to disturbance noise improves.

Figure 3:
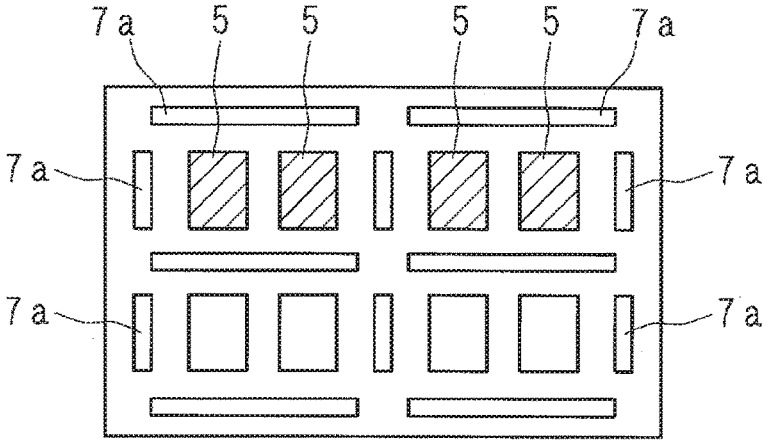
FIG. 3 is a cross-sectional view illustrating another example of transverse section taken along line a-a' in FIG. 1A.

Note that the female terminal surrounding conductor 7 and the male terminal surrounding conductor 10 need not have a lattice shape or a tube shape completely surrounding each terminal pair without a gap, and a female terminal surrounding conductor 7*a* and a male terminal surrounding conductor in which gaps are provided in the four corners of each rectangle in cross-section, as shown in FIG. 3, for example, can achieve the same effects.

EXAMPLE 2

Figure 4A:
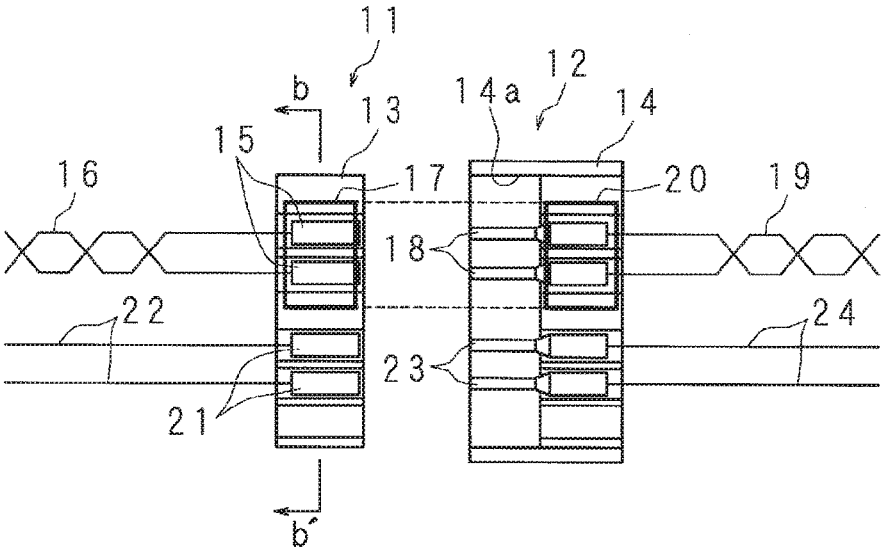
FIG. 4A is a cross-sectional view schematically illustrating a plane cross section of an example of the connector and the electrical wire unit according to the present invention.
Figure 4B:
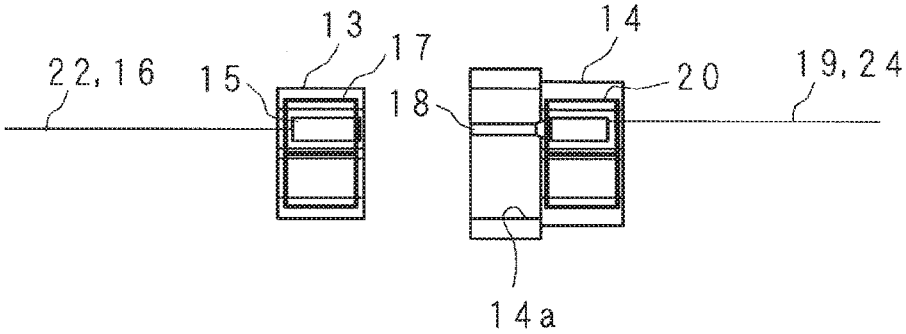
FIG. 4B is a cross-sectional view schematically illustrating a side cross section of the example of the connector and the electrical wire unit according to the present invention.
Figure 5:
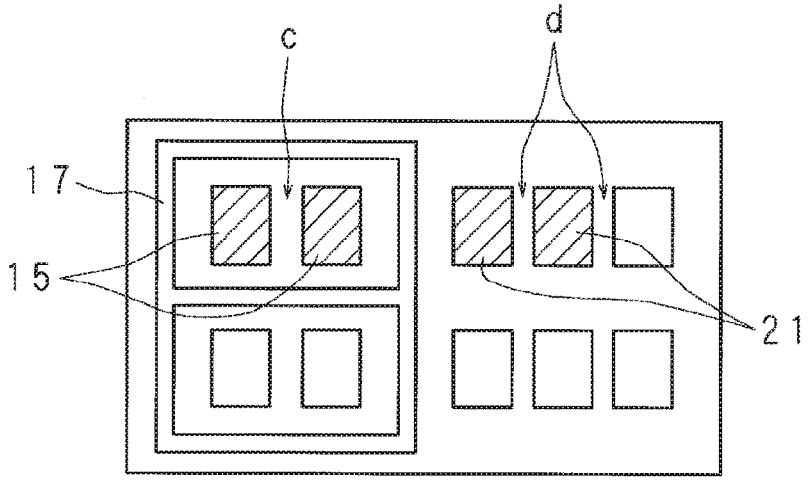
FIG. 5 is a cross-sectional view illustrating a transverse section taken along line b-b' in FIG. 4A.
Figure 6:
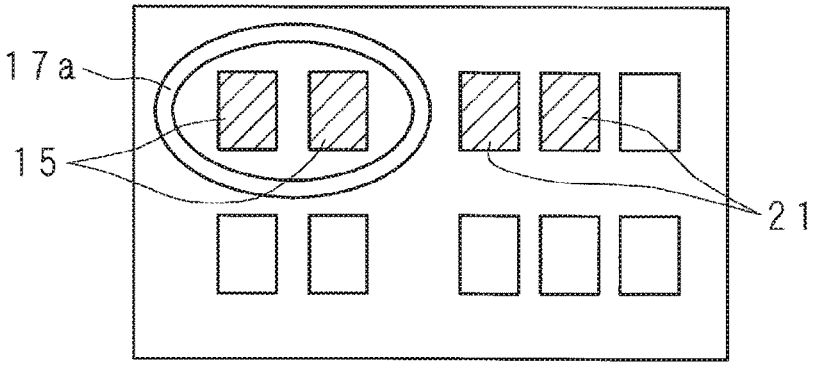
FIG. 6 is a cross-sectional view illustrating another example of transverse section taken along line b-b' in FIG. 4A.

FIG. 4A is a cross-sectional view schematically illustrating a plane cross section of Example 2 of the connector and the electrical wire unit according to the present invention, FIG. 4B is a cross-sectional view schematically illustrating a side cross section of Example 2, and FIG. 5 is a cross-sectional view illustrating a transverse section taken along line b-b' in FIG. 4A.

As shown in FIGS. 4A and 4B, the connector and the electrical wire unit include a female connector 11 to which twisted pair lines 16 and two ordinary (non-twisted) wires 22 are connected and that includes a housing 13 having a cuboid shape, and a male connector 12 to which twisted pair lines 19 and two ordinary wires 24 are connected and that includes an approximately cuboid-shaped housing 14 that is provided with a recess 14*a* into which the female connector 11 is to be fitted.

Two tube-shaped female terminals 15 and three female terminals 21 to which pin-shaped male terminals 18 and male terminal 23 are respectively fitted and connected are embedded into the female connector 11, and are arrayed in (2+3)×2 rows on a connection side (note that, here, one row of female terminals 15 and 21 and one female terminal 21 are empty), as shown in FIG. 5. The length of the housing 13 in a thickness direction (length direction of the twisted pair lines 16) is slightly larger than the length of the female terminals 15, as shown in FIGS. 4A and 4B.

A pair of female terminals 15 that are adjacent to each other is surrounded by a lattice-shaped female terminal surrounding conductor 17, as shown in FIG. 5, and are connected to the twisted pair lines 16. The pair of the female terminals 15 and a portion of the female terminal surrounding conductor 17 that surrounds them have a mirror symmetric shape, in cross-section, whose axis of symmetry is a line in the middle between the two terminals. The female terminal surrounding conductor 17 is embedded into the housing 13 in a state of being insulated from other members.

The female terminals 21 are not surrounded by the female terminal surrounding conductor 17, and are each connected to an ordinary wire 22 such as a power line.

Two pin-shaped male terminals 18 and three male terminals 23 are embedded into the male connector 12, and are arrayed in (2+3)×2 rows on a connection side (note that, here, one row of male terminals 18 and 23 and one male terminal 23 are empty). The length of the housing 14 in a thickness direction (length direction of the twisted pair lines 19) is slightly larger than the length of the male terminals 18 and 23, as shown in FIGS. 4A and 4B.

Approximately half of the respective male terminals 18 on a side connected to the twisted pair lines 19 and approximately half of the respective male terminals 23 on a side connected to ordinary wires 24 are embedded into the housing 14, and the other half thereof projects into the recess 14*a* into which the female connector 11 is to be fitted.

Portions of the pair of the male terminals 18 that are adjacent to each other that are embedded into the housing 14 are surrounded by a lattice-shaped male terminal surrounding conductor 20, and are connected to the twisted pair lines 19. The pair of male terminals 18 and a portion of the male terminal surrounding conductor 20 that surrounds it have a mirror symmetric shape, in cross-section, whose axis of symmetry is a line in the middle between the two terminals. The male terminal surrounding conductor 20 is embedded into the housing 14 in a state of being insulated from other members.

The female terminal surrounding conductor 17 and the corresponding male terminal surrounding conductor 20 have the same shape in cross-section.

The female terminals 15 that are surrounded by the female terminal surrounding conductor 17 are arranged with a gap c between them that is larger than the gaps d between the female terminals 21 that are not surrounded by the female terminal surrounding conductor 17 such that the characteristic impedance does not change much in a length direction. For example, if the characteristic impedance is 100Ω, the gap c between the female terminals 15 is larger than the gaps d between the female terminals 21 by approximately 100 μm.

In the connector and the electrical wire unit having such a configuration, when the female connector 11 is fitted into the recess 14*a* of the male connector 12, the pin-shaped male terminals 18 and 21 are respectively fitted into the tube-shaped female terminals 15 and 21 and are connected thereto. At this time, the corresponding female terminal surrounding conductor 17 and male terminal surrounding conductor 20 are connected, and the pair of female terminals 15 and the pair of male terminals 18 are surrounded by the female terminal surrounding conductor 17 and the male terminal surrounding conductor 20.

Accordingly, the characteristic impedance does not change much in the connector portion of the electrical wire unit, and crosstalk characteristics and normal/common conversion characteristics do not degrade, and noise immunity to disturbance noise improves.

Note that the cross-sections of the female terminal surrounding conductor 17 and the male terminal surrounding conductor 20 are not limited to a rectangle such as a lattice shape, and a female terminal surrounding conductor 17*a* and a male terminal surrounding conductor each having an elliptical shape, in cross-section, that surround the terminals with a mirror symmetric shape whose axis of symmetry is a line in the middle between the two terminals, can achieve the same effects.

EXAMPLE 3

Figure 7:
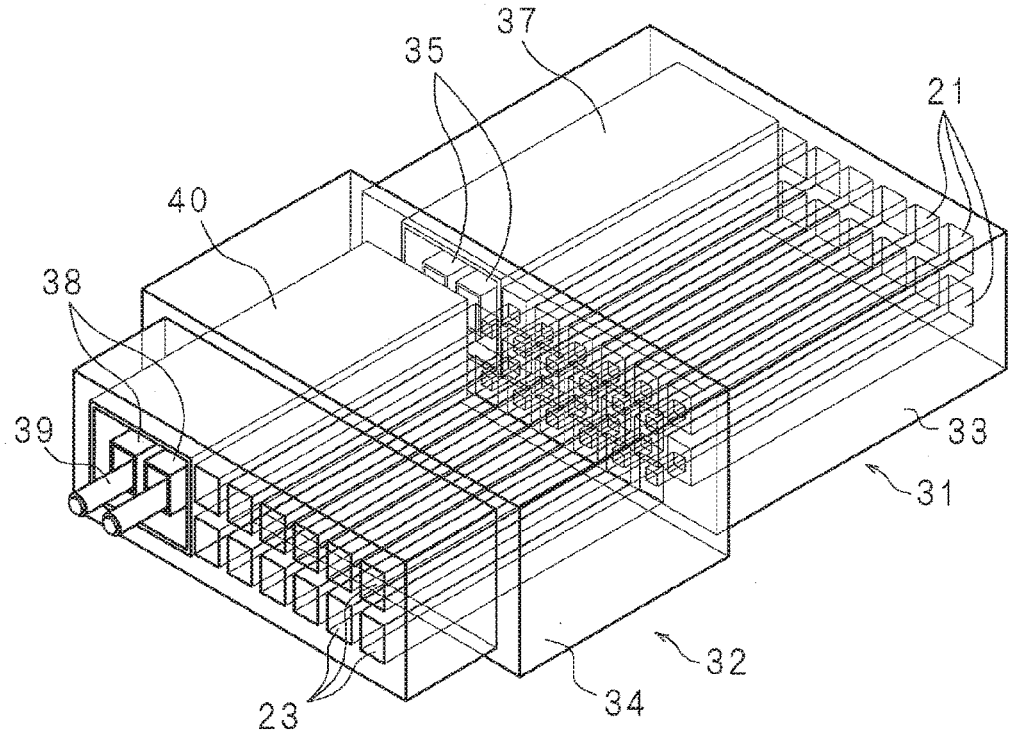
FIG. 7 is a perspective view illustrating a schematic configuration of an example of the connector and the electrical wire unit according to the present invention, in which portions thereof are shown in a see-through manner.
Figure 8A:
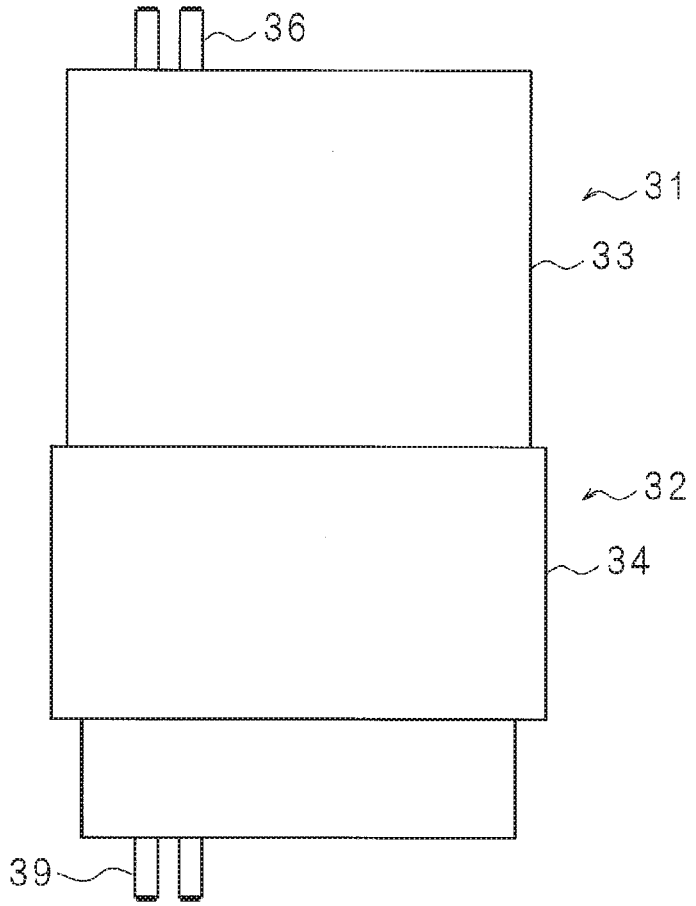
FIG. 8A is a plan view illustrating an external appearance of an example of the connector and the electrical wire unit according to the present invention.
Figure 8B:
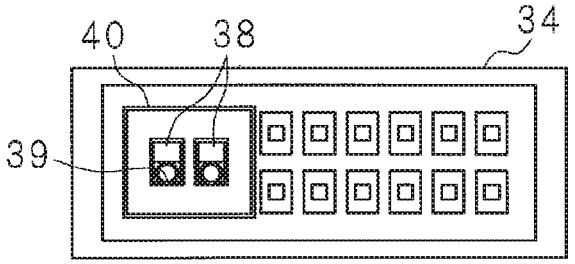
FIG. 8B is a front view illustrating the external appearance of the example of the connector and the electrical wire unit according to the present invention.
Figure 9:
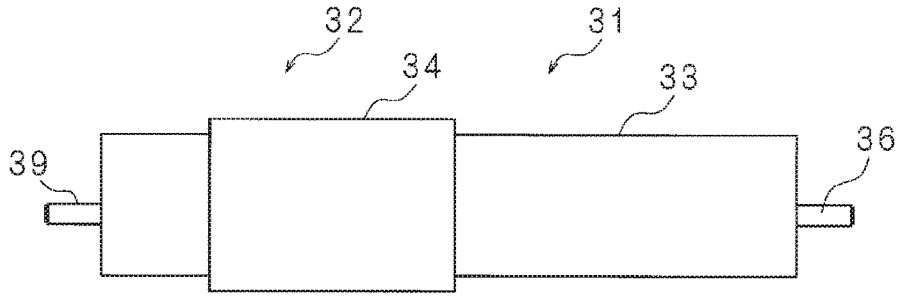
FIG. 9 is a side view illustrating the external appearance of the example of the connector and the electrical wire unit according to the present invention.

FIG. 7 is a perspective view illustrating a schematic configuration of Example 3 of the connector and the electrical wire unit according to the present invention, in which portions thereof are shown in a see-through manner, FIG. 8A is a plan view illustrating an external appearance of Example 3, FIG. 8B is a front view illustrating the external appearance of Example 3, and FIG. 9 is a side view illustrating the external appearance of Example 3.

The connector and the electrical wire unit includes a male connector 31 to which a pair of twisted pair lines 36 are connected and that includes a housing 33 having a cuboid shape, and a male connector 32 to which a pair of twisted pair lines 39 are connected and that includes a housing 34 having an approximately cuboid shape.

The male connector 31 includes two tube-shaped male terminals 35 that are embedded in a housing 33, and are arranged in a longitudinal direction of the housing 33, in cross-section. The two male terminals 35 are surrounded by a tube-shaped male terminal surrounding conductor 37, and are connected to twisted pair lines 36. The two male terminals 35 and the male terminal surrounding conductor 37 that surrounds them have a mirror symmetric shape, in cross-section, whose axis of symmetry is the intermediate line of the two male terminals 35. The male terminal surrounding conductor 37 is embedded into the housing 33 in a state of being insulated from other members.

In a space of the housing 33 other than the space occupied by the male terminal surrounding conductor 37, two rows of six tube-shaped female terminals 21 that are arranged in a longitudinal direction of the housing 33, in cross-section, are embedded. Here, no wires are connected to the female terminals 21.

The male connector 32 includes two female terminals 38, each having a pin-shaped tip, that are arranged in a longitudinal direction of the housing 34, in cross-section, so as to respectively correspond to the two male terminals 35, and are embedded in the housing 34. The two female terminals 38 are surrounded by a tube-shaped female terminal surrounding conductor 40, and are connected to twisted pair lines 39. The two female terminals 38 and the female terminal surrounding conductor 40 that surrounds them have a mirror symmetric shape, in cross-section, whose axis of symmetry is the intermediate line of the two female terminals 38. The female terminal surrounding conductor 40 is embedded into the housing 34 in a state of being insulated from other members.

In a space of the housing 34 other than the space occupied by the female terminal surrounding conductor 40, two rows of six male terminals 23, each having a pin-shaped tip, that are arranged in a longitudinal direction of the housing 34, in cross-section, are embedded. Here, no wires are connected to the male terminals 23.

The male terminal surrounding conductor 37 and the corresponding female terminal surrounding conductor 40 have the same shape in cross-section.

In the connector and the electrical wire unit having such a configuration, the female terminals 38 each having a pin-shaped tip are respectively fitted into the tube-shaped male terminals 35 and are connected thereto. At this time, the corresponding male terminal surrounding conductor 37 and female terminal surrounding conductor 40 are connected, and the pair of male terminals 35 and the pair of female terminals 38 are surrounded by the male terminal surrounding conductor 37 and the female terminal surrounding conductor 40.

Accordingly, the characteristic impedance does not change much in the connector portion of the electrical wire unit, and crosstalk characteristics and normal/common conversion characteristics do not degrade, and noise immunity to disturbance noise improves.

The examples disclosed herein are examples in all aspects, and should be considered to be not restrictive. The scope of the present invention is indicated not by the above-stated meanings but by the scope of claims, and is intended to include all modifications that are within the meanings and the scope that are equivalent to those of the scope of claims.

INDUSTRIAL APPLICABILITY

The present invention is applicable to a connector and an electrical wire unit that are used in a communication line and a power line, which connect electrical devices, such as a wire harness for a vehicle.

The invention claimed is:

1. A connector including a first connector that includes one pair or a plurality of pairs of first terminals that are provided in one housing, and that are configured to be connected to non-shielded electric wires and a second connector that includes one pair or a plurality of pairs of second terminals that are provided in another housing, and that are configured to be connected to the one pair or the plurality of pairs of first terminals, the connector comprising:

one or a plurality of first terminal surrounding conductors that are fixed inside the one housing, that individually surround the pairs of first terminals, and that are insulated from other members; and one or a plurality of second terminal surrounding conductors that are fixed inside the other housing, that individually surround the pairs of second terminals, and are insulated from other members, wherein the first terminals and the second terminals are respectively surrounded by the first terminal surrounding conductors and the second terminal surrounding conductors such that a cross-section of each terminal pair and the corresponding terminal surrounding conductor has a mirror symmetric shape whose axis of symmetry is a line in the middle between the terminals, and when the first terminals are respectively connected to the second terminals, the first terminal surrounding conductors are respectively connected to the corresponding second terminal surrounding conductors.

2. The connector according to claim 1, wherein the first connector further includes a plurality of other first terminals arranged with a gap between them that is smaller than a gap between the first terminals, and the second connector further includes a plurality of other second terminals arranged with a gap between them that is smaller than a gap between the second terminals.

3. An electrical wire unit comprising: the connector according to claim 2; wherein one or a plurality of twisted pair lines that are respectively connected to first terminal pairs included in the connector; and one or a plurality of twisted pair lines that are respectively connected to second terminal pairs included in the connector.

4. An electrical wire unit comprising: the connector according to claim 1; wherein one or a plurality of non-shielded twisted pair lines that are respectively connected to first terminal pairs included in the connector; and one or a plurality of non-shielded twisted pair lines that are respectively connected to second terminal pairs included in the connector.

* * * * *